United States Patent [19]

Lund

[11] 4,175,497

[45] Nov. 27, 1979

[54] KNIFE ASSEMBLY FOR A TUFTING MACHINE

[75] Inventor: Ernest K. Lund, Accrington, England

[73] Assignee: Edgar Pickering (Blackburn) Ltd., Blackburn, England

[21] Appl. No.: 858,027

[22] Filed: Dec. 6, 1977

[51] Int. Cl.[2] ..... D05C 15/24

[52] U.S. Cl. ..... 112/79 R

[58] Field of Search ..... 112/79 R, 79 A, 79 FF, 112/78; 83/700

[56] References Cited

U.S. PATENT DOCUMENTS

| | | | |
|---|---|---|---|
| 3,604,379 | 9/1971 | Cobble | 112/79 R |
| 3,757,709 | 9/1973 | Cobble | 112/79 R |

*Primary Examiner*—H. Hampton Hunter

*Attorney, Agent, or Firm*—Watson, Cole, Grindle & Watson

[57] ABSTRACT

A knife assembly for a tufting machine includes a knife bar; a plurality of knife blocks mounted side by side on the knife bar; projecting pegs extending from the knife blocks which are each inserted into one hole of a row of uniformly spaced retaining holes in one side of the knife bar; clamping screws for retaining the pegs in the holes; and a row of uniformly spaced pins carried by the knife, or a plate attached to the knife bar, which engage corresponding slots in the faces of the knife blocks from which the pegs project to determine the orientation of the blocks with respect to the knife bar, the pins being laterally offset by the same amount with respect to the retaining holes; and knives mounted in the knife blocks.

4 Claims, 3 Drawing Figures

KNIFE ASSEMBLY FOR A TUFTING MACHINE

BACKGROUND OF THE INVENTION

A tufting machine for forming cut pile fabric conventionally includes a reciprocating needle bar carrying needles which at each machine cycle project a row of loops of yarn through a backing fabric in a direction transverse to the direction of travel of the fabric, loopers which enter and retain the loops, and knives mounted by knife blocks on an oscillating knife bar which cut the loops held on the loopers.

In such a machine it is necessary that all the numerous knife blocks be accurately located on the knife bar at the correct orientation and maintainable in such accurate positioning, notwithstanding the stresses and vibration imposed upon them during operation of the machine.

In an existing machine, each knife block, conveniently carries a pair of upwardly extending knives and has a peg which is received in a hole in the side of the knife bar, the knife block being retained in the desired orientation with respect to the knife block by a clamping screw fitted into a hole in the base of the knife bar to engage the peg. With this arrangement it is difficult to ensure that all the knife blocks are mounted at the correct orientation on the knife bar and it is also difficult to ensure that all the knife blocks will be tightly clamped in position and maintained in their correct correct orientation. Also, the mounting of the knife blocks on the knife bar is a highly skilled operation since the knife blocks must be set individually at the correct angle.

SUMMARY OF THE INVENTION

The present invention provides a knife assembly for a tufting machine comprising a knife bar, a plurality of knife blocks mounted side by side on the knife bar, the knife blocks carrying projecting pegs, each peg being inserted into one of a row of uniformly spaced retaining holes in one side of the knife bar and retained therein by a clamping screw, and a row of uniformly spaced pins carried by the knife bar which engage corresponding slots in the faces of the knife blocks from which the pegs project to determine their orientation with respect to the knife bar, the pins being laterally offset by the same amount with respect to the retaining holes, and knives mounted in the knife blocks.

With this arrangement the pins determine positively the inclination of the knife blocks with respect to the knife bar so that they will not become disoriented if the clamping screws should become slack, and there is no necessity for the clamping screws to be tightened to an excessive extent. No undue strain is imposed on the pins. Furthermore, the knife blocks can be fitted to the knife bar by semi-skilled or unskilled workmen.

Preferably the pins are carried on a plate attached to the top of the knife bar. It is sometimes desired by the user of a tufting machine to change the inclination of the knife blocks to the knife bar to suit variations in the yarn used or the gauge of the machine. Provision for this may be made by supplying interchangeable plates carrying differently disposed pins. Alternatively, as described in more detail below, the plate may be adjustable in position with respect to the knife bar.

One embodiment of knife assembly according to the invention is illustrated, by way of example, in the accompanying drawings.

DESCRIPTION OF THE PREFERRED EMBODIMENT

Figure 3:
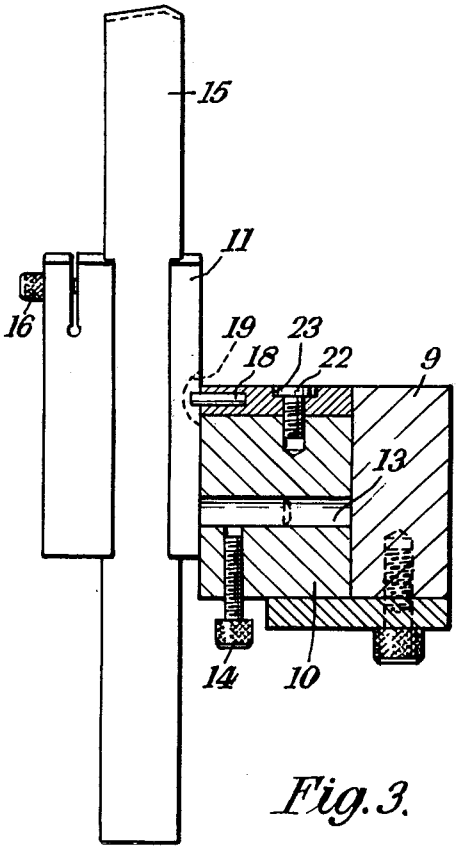
FIG. 3 is a sectional view taken along the inventive line III—III in FIG. 2.
Figure 1:
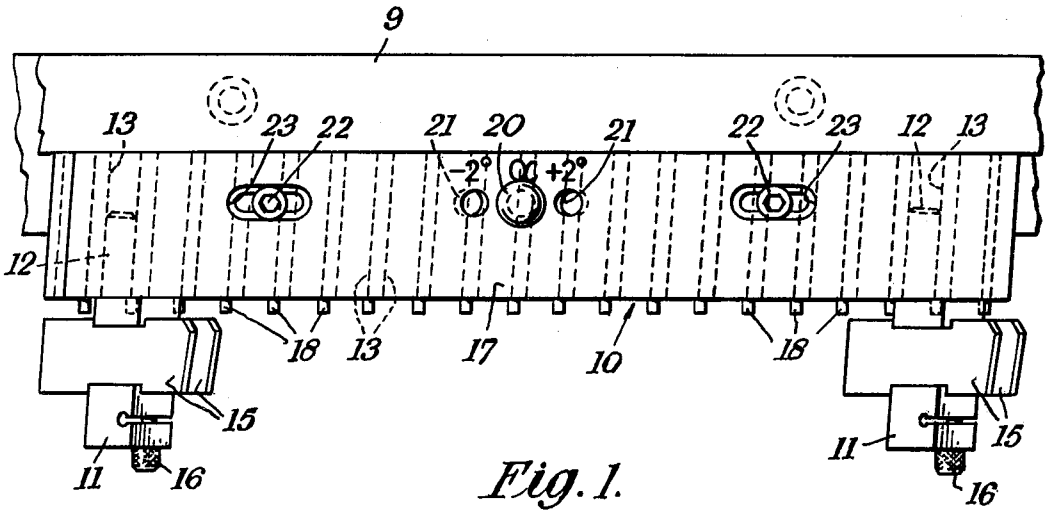
FIG. 1 is a plan view of the inventive assembly.
Figure 2:
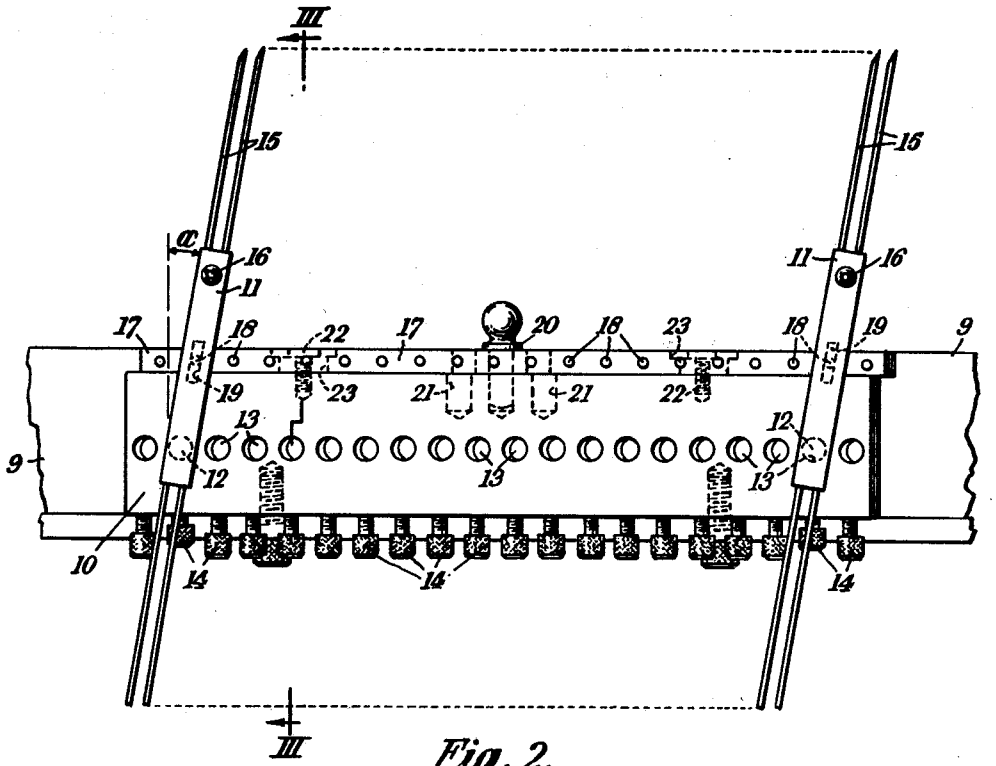
FIG. 2 is a front elevational view of the inventive assembly.

The knife assembly illustrated includes a knife bar carrier 9 which may have a continuous length of up to 15 feet and which is oscillated in operation to impart the cutting action to the knives. The carrier 9 carries a knife bar formed of individual sections 10, e.g. 7½ inches in length, only one of which is shown in the drawings. The sections 10 are secured in abutting relationship to the carrier 9 by means not shown. Each section 10 of the knife bar carries a number of knife blocks 11, only two of which are shown in FIG. 2. The knife blocks 11 carry pegs 12, each of which engages one of a series of equally spaced holes 13 in the side of the section 10, in which it is retained by a clamping screw 14, as shown in FIGS. 2 and 3. Each hole 13 is drilled at a small angle, e.g. 4°, to the perpendicular to the front face of the section 10 so that the outer ends of the holes are slightly displaced to the right, as seen in FIG. 1, with reference to their inner ends.

Each knife block 11 carries two knives 15, which are retained in the knife block by screws 16. A plate 17, mounted on top of the section 10, carries a number of equally spaced pins 18, angled at 4° to match the holes 13, which engage in slots 19 in the bases of the knife blocks to determine their angle of orientation $\alpha$ with respect to the vertical.

The plate 17 is normally located in relation to the section 10 by engagement of a dowel 20 through a hole in the plate, e.g., in the centre one of three holes 21 in the section 10, and plate 17 is secured to the section 10 by screws 22 which extend through slots 23 in the plate. The angle $\alpha$ is then 10°, the most generally desired value. The angle $\alpha$ can, however, be increased or decreased by 2° by relocating the plate 17 so that the dowel engages a respective one of the other two holes 21. These angles are exemplary only and can be varied to suit requirements.

As an alternative, the holes 21 may be screw-threaded and two spaced groups of such holes provided, and clamping screws inserted into appropriate ones of the holes to attach the plate 17 to the section 10. In this case the screws 22 and slots 23 will not be required.

What I claim as my invention and desire to secure by Letters Patent is:

1. A knife assembly for a tufting machine comprising a knife bar, a plurality of knife blocks mounted side by side on the knife bar, the knife blocks carrying projecting pegs respectively extending from each of said knife blocks into one of a row of uniformly spaced retaining holes in one side of the knife bar, a clamping screw positioned to maintain each projecting pin in a retaining hole, a plate mounted on top of the knife bar, a row of uniformly spaced pins carried by the plate which engage corresponding slots in the faces of the knife blocks from which the pegs project to determine their orientation with respect to the knife bar, the pins being laterally offset by the same amount with respect to the retaining holes, means for detachably connecting the plate to the knife bar in at least two alternative positions providing orientatation of the knife blocks to the knife bar at different angles, and knives mounted in the knife blocks.

2. A knife assembly according to claim 1, wherein said means for detachably connecting the plate to the knife bar in at least two alternative positions providing orientation of the knife blocks to the knife bar at different angles includes a dowel which is engageable through a hole in the plate with alternative positioning holes in the knife bar and screws which are positioned to extend through slotted holes in said plate and threadably engage with said knife bar for securing the plate to the knife bar with the dowel engaged in one of said positioning holes.

3. A knife assembly according to claim 1, in which the knife bar consists of a plurality of sections mounted in abutting relationship on a carrier.

4. A knife assembly according to claim 2, wherein said means for detachably connecting the plate to the knife bar in at least two alternative positions providing orientation of the knife blocks to the knife bar at different angles includes clamping screws positioned to extend through holes in said plate and engage with spaced-apart threaded holes in said knife bar.

* * * * *